US009663965B2

(12) United States Patent
Ramon

(10) Patent No.: US 9,663,965 B2
(45) Date of Patent: May 30, 2017

(54) FENCE FOR USE AS BARRIER INSTALLATION

(71) Applicant: Xavier Ramon, Marke (BE)

(72) Inventor: Xavier Ramon, Marke (BE)

(73) Assignee: BOPLAN BVBA, Marke (BE)

( * ) Notice: Subject to any disclaimer, the term of this patent is extended or adjusted under 35 U.S.C. 154(b) by 730 days.

(21) Appl. No.: 13/632,464

(22) Filed: Oct. 1, 2012

(65) Prior Publication Data

US 2014/0091269 A1 Apr. 3, 2014

(51) Int. Cl.
*E04H 17/14* (2006.01)
*E01F 13/02* (2006.01)

(52) U.S. Cl.
CPC ..... *E04H 17/1413* (2013.01); *E01F 13/022* (2013.01); *E04H 2017/1465* (2013.01)

(58) Field of Classification Search
USPC ..... 256/59, 65.02, 65.03, 65.11, 65.12
See application file for complete search history.

(56) References Cited

U.S. PATENT DOCUMENTS 2,844,910 A * 7/1958 Korchak ..... 446/106
3,129,965 A * 4/1964 Stark ..... 403/217
3,204,779 A * 9/1965 Warner ..... 211/190
3,638,814 A * 2/1972 Lowery ..... 211/189
3,747,965 A * 7/1973 Wing ..... 403/173
3,837,754 A * 9/1974 Malcik ..... 403/217
3,921,960 A * 11/1975 Bright ..... 256/65.12
4,012,090 A * 3/1977 Pfeifer et al. ..... 312/348.2
5,161,783 A * 11/1992 German ..... 256/19
5,312,089 A * 5/1994 Venegas, Jr. ..... 256/65.12
5,458,428 A * 10/1995 West ..... 403/252
5,601,278 A * 2/1997 Graber ..... 256/66
6,036,176 A * 3/2000 Rotshtain ..... 256/59
7,266,932 B2 * 9/2007 Rowan ..... 52/656.1
7,503,551 B2 * 3/2009 Auret ..... 256/65.12
2005/0121658 A1 * 6/2005 Smith ..... 256/65.11
2009/0266574 A1 * 10/2009 Atkinson et al. ..... 174/67

* cited by examiner

*Primary Examiner* — Daniel Wiley
(74) *Attorney, Agent, or Firm* — Symbus Law Group, LLC; Clifford D. Hyra

(57) ABSTRACT

A fence (1) has at least two hollow fence posts (2), between which at least two crossbeams (3) extend, where each crossbeam (3) fits into an opening (4) provided in the fence post (2), a plate-shaped blocking element (5) extending into the cavity of the fence post (2) which is provided to block the crossbeams (3) against displacement, where the crossbeam (3) is provided in its external circumference with at least one recess (6) which lies within the hollow inner area of the fence post (2) and wherein the plate-shaped blocking element (5) is movable between a first position and a second position in which the crossbeam (3) is blocked in place.

10 Claims, 4 Drawing Sheets

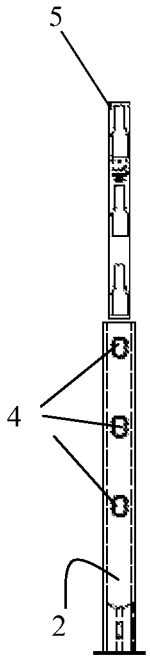
Fig. 8.1
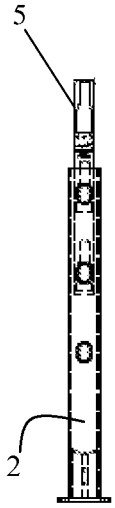
Fig. 8.2
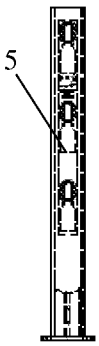
Fig. 8.3
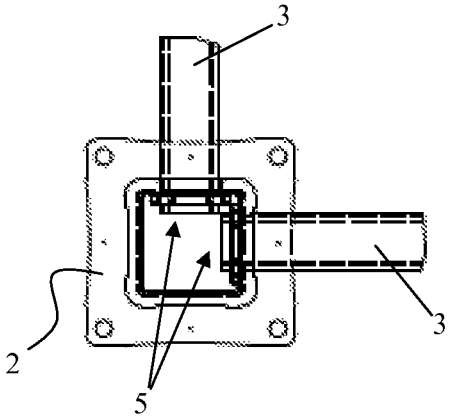
Fig. 9

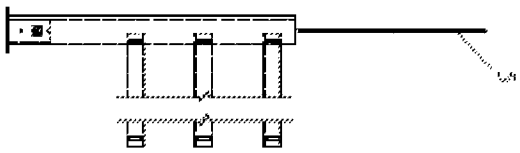
FIG. 8.4
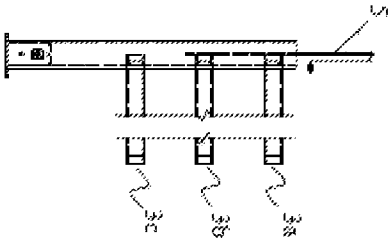
FIG. 8.5
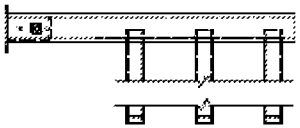
FIG. 8.6

FENCE FOR USE AS BARRIER INSTALLATION

BACKGROUND

In practice, a fence in the form of posts or barriers is set up temporarily or permanently in many companies at various locations with the aim of preventing machinery, objects and the like from being damaged by vehicles or means of transport during maneuvering. A fence of this type can also be used as a screen to protect persons, for example to prevent them from falling downwards.

A multiplicity of fences (fence systems) have already been developed, wherein rigid crossbeams are connected via a welded connection to a number of vertically disposed posts. However, a construction of this type has the disadvantage that the positioning thereof requires a lot of time and, furthermore, it is subsequently difficult to move and repair.

In order to solve the aforementioned problem relating to the welded fences and furthermore enable more configuration options, the European patent publication EP 1 483 160 describes a fence with interlockable components, comprising a number of upright posts, between which a crossbeam made from a tubular plastic material extends, and which fits into a first opening provided in an upright post. The end of the crossbeam is provided with a second opening which lies within the hollow inner area of the vertical post. In order to block the crossbeam, the fence described in EP 1 483 160 comprises a blocking element similarly made from a tubular plastic material. In order to now block the crossbeam, the tubular blocking element is forced into the aforementioned second opening, which is too small in relation to the tubular blocking element. Given that the second opening is too small for the tubular blocking element, the material of the blocking element will be slightly compressed during the positioning thereof, at the second opening. This compression will become permanent through time, as a result of which, as it were, a slight protuberance is formed on each side of the second opening, and as a result of which the tubular blocking element is, as it were, held mechanically in position. However, this has the disadvantage that the construction is subsequently difficult to dismantle. Furthermore, the tubular blocking element forms an obstacle to any present wiring which extends through the different crossbeams.

The American patent publication U.S. Pat. No. 3,921,960 describes a fence comprising at least two hollow fence posts, between which at least two crossbeams extend. In a specific embodiment, the fence comprises a plate-shaped blocking element which is provided to block the crossbeams against displacement, and which is movable between a first position in which the crossbeams are movable into and out of the fence post and a second position in which the crossbeams are blocked in place. However, the fence described in U.S. Pat. No. 3,921,960 has the disadvantage that, on impact (for example due to a collision), the risk exists that only the blocking element will break, and, for example, only at one or more blocking positions (at the opening(s) in the blocking element). As the blocking element is located in the inner area of the fence post, the damage is not visible, so that the risk exists that the broken blocking element will not be replaced, as a result of which the crossbeam sits, as it were, loosely in the fence post. The crossbeam thereby loses its function and, on a following impact, will immediately come loose from the fence post, with all associated risks.

SUMMARY

A new fence has at least two hollow fence panels, between which at least two crossbeams extend, where each crossbeam fits into an opening provided in the fence post, and a blocking element extending into the cavity of the fence post which is provided to block the crossbeams against displacement. The fence may be designed specifically with the aim of offering an appropriate and economical solution as a barrier installation and/or screen and/or fall protection for a wide range of applications, both industrial and civil.

An object of this invention is now to provide a reliable fence which retains its specific function, even following an impact. An additional object is to provide a fence which can be simply and quickly assembled in situ, and which furthermore can subsequently be simply dismantled.

Objects of the invention are achieved by providing a fence having at least two hollow fence posts, between which at least two crossbeams extend, where each crossbeam fits into an opening provided in the fence post, a plate-shaped blocking element extending into the cavity of the fence post which is provided to block the crossbeams against displacement, where the crossbeams are provided in their external circumference with at least one recess which lies within the hollow inner area of the fence post and where the plate-shaped blocking element is movable between a first position in which the crossbeams are movable into and out of the fence post and a second position in which the crossbeams are blocked in place, where the aforementioned blocking element includes at least two openings positioned at a distance from one another, which are each provided to block a crossbeam against displacement, and where the aforementioned blocking element is provided between the aforementioned openings with one or more break lines, along which the blocking element is breakable into different separate blocking elements. In the event of any impact, the presence of break lines of this type will ensure that the blocking element will break at the disposed break lines into separate blocking elements, which will each still perform their function, i.e. the blocking of the relevant crossbeam. In this way, breaking of the blocking element at other places, for example at the blocking position, is avoided. Consequently, the presence of break lines of this type will provide a more reliable fence. Furthermore, a fence of this type is very quick to install and can subsequently be easily dismantled, since the blocking element, which ensures the interlocking between the fence post and the crossbeam, is easily movable between the first and second position. Given that the recesses are located on the outer circumference of the crossbeam, this fence has the advantage that the blocking element no longer forms an obstacle to any cabling or other elements (for example strengthening rods) which extend through the different crossbeams.

In the context of this invention, the aforementioned break lines must be regarded as a zone (a so-called break zone), which extends over virtually the entire width of the blocking element and is more breakable than the remainder of the blocking element. This can be achieved, for example, by designing the blocking element at the break zone as thinner than the remainder of the blocking element, or, for example, by making the break zone from a suitable material which breaks more easily than the material from which the remainder of the blocking element is made. It is evident that other solutions for providing a weaker zone in the blocking element similarly fall within the scope of protection of this invention.

In an embodiment of the fence according to the invention, the crossbeam has two recesses located opposite one another which extend across the longitudinal direction of the crossbeam. Both recesses may be symmetrically structured.

In another embodiment of the fence according to the invention, the fence posts are made from tubular plastic material, extending essentially vertically in the assembled condition of the fence, and the crossbeams are made from tubular plastic material, extending essentially horizontally in the assembled condition of the fence. These can be manufactured, for example, via injection moulding and/or extrusion.

According to a particular embodiment of the fence according to this invention, the openings provided in the blocking element have a width on their one side which is greater than the width of the crossbeam to be blocked and, on their opposite side, a width which is smaller than the width of the crossbeam to be blocked. More specifically, the opening is constructed from:

- a first part with a width which is greater than the width of the crossbeam to be blocked;
- a second part with a width which is smaller than the width of the crossbeam to be blocked;
- a third part which forms the transition between the first and second part and of which the width gradually decreases in the direction of the second part.

The specific shape, more specifically key-shaped, of the opening disposed in the blocking element allows the crossbeam to be moved into and out of the fence post in a first position of the blocking element, and to be blocked in a second position.

If the fence has a plurality of crossbeams positioned above one another, the latter can be blocked with the same blocking element. For this purpose, the blocking element, in a more particular embodiment of the fence, is provided with a first, second and third opening which are provided to block the first, second and third crossbeam respectively, wherein one or more break lines are provided between the first and second opening, and between the second and third opening. It is self-evident that, in the case of a fourth or possibly fifth crossbeam, the blocking element can further be provided with a fourth and fifth opening of a similar type.

According to an embodiment of the fence according to the invention, the blocking element has, in its outer circumference, at least one recess which is dimensioned in such a way that it is suitable to serve as a grip during the movement of the blocking element between the first and second position. The blocking element may have two recesses located opposite one another which are dimensioned in such a way that they are suitable to serve as a grip during the movement of the blocking element between the first and second position. Recesses of this type give the user of the fence the facility to grip the blocking element easily and firmly with the fingers of the hand in order to move it between the first and second position, or to insert it easily into the vertically disposed fence post and to push it over the one or more crossbeams or to easily remove the blocking element.

In an embodiment of the fence according to the invention, the blocking element is made from plastic. As a result, the required shape thereof can be simply implemented, for example, via injection moulding.

In a particular embodiment of the fence according to the invention, the fence post has at least one essentially flat rear side and front side and at least two essentially flat side surfaces, and, following attachment of the crossbeam to the fence post, the blocking element lies against one of the flat side surfaces. In this embodiment, the blocking element in the assembled condition will exert a tension both sideways and from above on the inserted crossbeam i.e. if a horizontal or vertical force is exerted on the fence, the crossbeam is always clamped in place with two sides. In specific cases, even three sides will offer resistance. In the event of impact on the fence, the end of the crossbeam will bend through, so that the side edges of the fence post (with a vertical cross-section) will also exert resistance on the flat blocking element and will thereby bear (absorb) a part of the force.

In an alternative embodiment of the fence according to the invention, the fence post has a round cross-section and, following attachment of the crossbeam to the fence post, the blocking element lies against a curved side wall. In this embodiment, the flat blocking plate will, as it were, be forced during the assembly to assume the shape of the fence post and as a result will be slightly curved. As a result, an additional tension will be created which will ensure that the fence becomes stronger.

According to a more particular embodiment of the fence according to the invention, the fence post includes a base plate in order to attach it to an underlying structure.

This invention is now explained in detail with reference to the following detailed description of an embodiment of a fence according to this invention. The purpose of this description is exclusively to provide illustrative examples and to indicate further advantages and special features of this fence, and cannot therefore be interpreted as a limitation of the scope of application of the invention or of the patent rights asserted in the claims.

BRIEF DESCRIPTION OF THE DRAWINGS

In the detailed description, reference figures are used to refer to the attached drawings, in which:

FIGS. 8.1, 8.2 and 8.3 and corresponding side views FIGS. 8.4, 8.5 and 8.6 indicate step-by-step how the fence is assembled;

FIG. 9 shows how an angle can be formed in the fence.

DETAILED DESCRIPTION OF EMBODIMENTS

Figure 1:
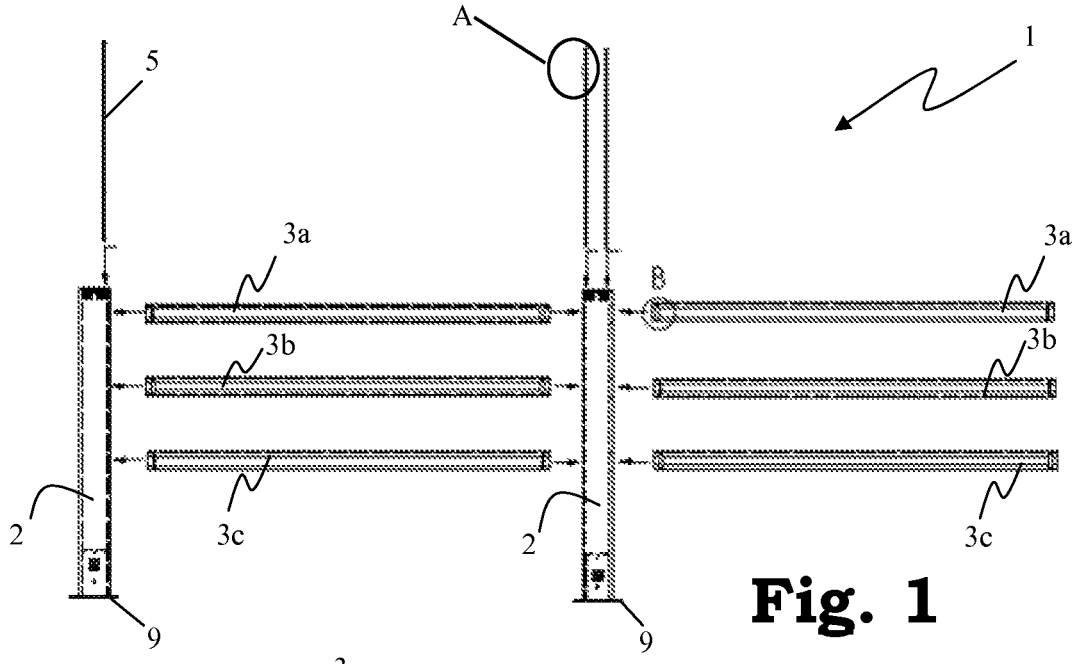
FIG. 1 is a representation of a fence according to this invention.
Figure 5:
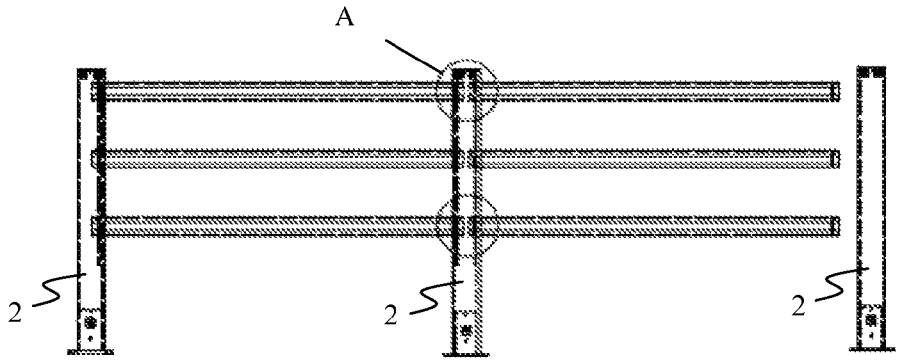
FIG. 5 is a front view of a fence according to the invention.

A fence (1) according to this invention, as shown, inter alia, in FIGS. 1 and 5, includes two or more fence posts (2), between which at least two crossbeams (3) extend. In the figures shown, three crossbeams (3*a*;3*b*;3*c*) are provided in each case between vertically standing fence posts (2). The fence (1) according to this invention can be designed as a straight line, but it is also possible to design it as angular (see, for example FIG. 9).

The fence posts (2), which are shown in FIGS. 1, 5 and 8, are hollow posts with a simple basic form, so that they can be simply produced. They have an essentially flat rear side, two essentially flat side areas and a flat front side. However, the fence posts may also have a round cross-section. The fence posts (2) may, for example, be made from an aluminium alloy, or from steel, or from plastic, etc., and may, for example, be manufactured via folding, or via welding, via injection moulding, or via extrusion, etc. These fence posts (2) may be manufactured from a tubular plastic material, and, in the assembled condition of the fence (1), will extend essentially vertically. The crossbeams (3) may also be made from tubular plastic material, and, in the assembled condition of the fence (2), will essentially extend horizontally.

Figure 6:
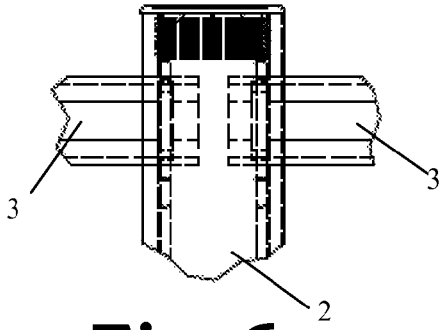
FIG. 6 is a detailed representation of the area A encircled in FIG. 5.

The fence (1) includes at least two hollow fence posts (2), between which at least two crossbeams (3) extend, wherein each crossbeam (3) fits into a specific opening (4) provided in the fence post (2). The crossbeam (3) will extend partially into the hollow inner area of the fence post (2) after it has been inserted into the opening (4). In principle, the fence post (2) may have as many openings (4) as the number of crossbeams which must be assembled between two vertically positioned fence posts. The openings (4) are provided in the two side areas if the fence post (2) is used as an intermediate post (see, for example, FIG. 6), and are provided in one side area if the fence post (2) is used as an end post.

Figure 4:
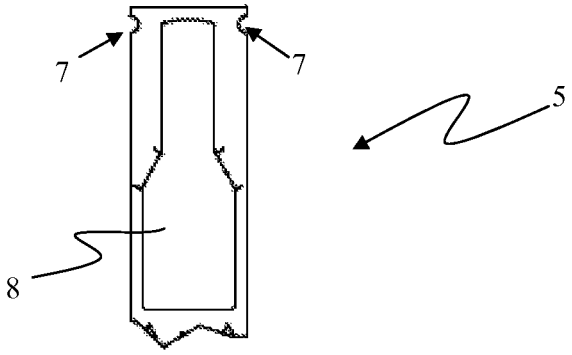
FIG. 4 is a detailed representation of the area A encircled in FIG. 1, on which a side view of a part of the blocking element is shown.

In order to interlock the crossbeam (3) fitted into the fence post (2) and in this way block it against displacement, a blocking element (5) is provided in the hollow inner area of the fence post (2). As shown, inter alia, in FIG. 4, this blocking element (5) may be made from a plastic plate in which an opening (8) is provided. The blocking element (5) may have a thickness of between 2 and 25 mm.

Figure 2:
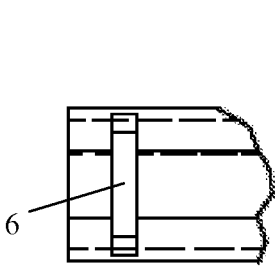
FIG. 2 is a detailed representation of the area B encircled in FIG. 1, on which a side view of an end of the crossbeam is shown.
Figure 3:
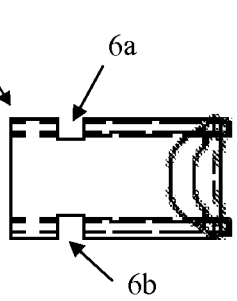
FIG. 3 is a detailed representation of the area B encircled in FIG. 1, on which a top view of an end of the crossbeam is shown.

The plate-shaped blocking element (5) is movable between a first position in which the crossbeam (3) is movable into and out of the fence post (2) and a second position in which the crossbeam (3) is blocked in place. In order to block the crossbeam (3) by means of the blocking element (5) or allow it to move into and out of the fence post (2), the crossbeam (3), as shown in FIGS. 2 and 3, has at least one recess (6*a*;6*b*) which, in the assembled condition, lies within the hollow inner area of the fence post (2), and wherein the blocking element (5) is movable. The crossbeam (3) may have two recesses (6*a* and 6*b*) located opposite one another, which extend across the longitudinal direction of the crossbeam (3). By using a blocking element (5) of this type and because the blocking element (5), following attachment of the crossbeam (3) to the fence post (2), lies against one of the flat side surfaces, an extremely reliable connection of the crossbeam (3) to the fence post (2) is obtained. If the flat blocking element (5) is assembled in fence posts (2) with a round cross-section, an even stronger fence (1) is obtained because, as a result of the deformation of the blocking element (5) during the assembly, an additional tension is created on the crossbeam (3) and the fence post (2).

Such a way of connecting, wherein the described blocking element is used, furthermore allows the fence to be dismantled in a simple manner, simply by moving the blocking element (5) from the second to the first position.

As previously mentioned, the blocking element (5) has an opening (8). The specific shape of the opening (8) (see, for example, FIG. 4) allows the crossbeam (3) to be moved into and out of the fence post (2) in a first position of the blocking element (5), and to be blocked in a second position. On the one side of the blocking element, which, in the assembled condition, is the underside, the opening (8) has a width which is greater than the width of the crossbeam (3) to be blocked, and, on the opposite side (the upper side of the blocking element), has a width which is smaller than the width of the crossbeam (3) to be blocked. More specifically, the opening is constructed from:

- a first part with a width which is greater than the width of the crossbeam (3) to be blocked;
- a second part with a width which is smaller than the width of the crossbeam (3) to be blocked;
- a third part which forms the transition between the first and second part and of which the width gradually decreases in the direction of the second part.

Figure 7:
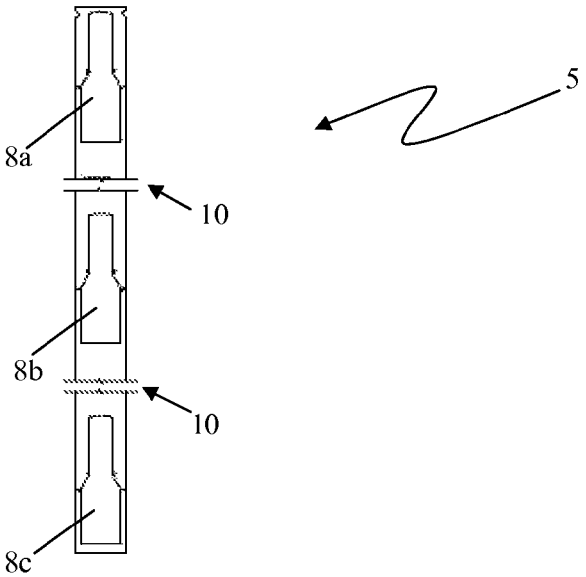
FIG. 7 is a front view of a blocking element provided with break lines between the different openings.

If a plurality of crossbeams (3*a*;3*b*;3*c*) are provided between two vertically disposed fence posts (2), they can be blocked with the same blocking element (5). For this purpose, the blocking element (5), as shown in FIG. 7, is provided with a number of openings (8) as described above. Three crossbeams (3*a*,3*b*,3*c*) can be blocked with the blocking element (5) shown in FIG. 7. This is shown in successive steps in FIGS. 8.1 to 8.3. Between the different openings (8), the blocking element (5) furthermore comprises so-called break lines (10) or break zones, as a result of which different blocking elements can be formed. The break lines (10) may be formed by disposing a weakening in the material from which the blocking element is formed, which can be done, for example, by designing the blocking element at this specific location as thinner than the remainder of the blocking element, or by using a different material which is more breakable than the material from which the remainder of the blocking element is formed.

The presence of break lines of this type will ensure that, in the event of any impact, the blocking element will break at the disposed break lines into separate blocking elements, which will each still perform their function, i.e. the blocking of the relevant crossbeam. In this way, breaking of the blocking element at other places, for example at the blocking position, is avoided. Because a fence provided with a blocking element of this type which, even following an impact, provides for a continuing blocking of the crossbeams, a fence of this type will be much more reliable than the known fences.

As shown in FIG. 8.1, during the construction of the fence, the three crossbeams (3*a*,3*b*,3*c*) are inserted into the openings (4) provided in the fence post (2). The blocking element (5) is then inserted into the hollow inner area of the fence post and is pushed over the part of the crossbeam (3) which is located in the hollow inner area of the fence post (2) (see FIG. 8.2). At that moment, the blocking element (5) is located in its first position and the part of the opening (8) with a width which is greater than the width of the crossbeam to be blocked is located at a crossbeam (3*a*,3*b*,3*c*) so that the blocking element can be pushed over the different crossbeams until the blocking element comes into contact with the recesses (6*a*,6*b*) disposed in the crossbeams. If the user releases the blocking element (5) at that moment, it will fall downwards under the influence of gravity and be located in its second position (see FIG. 8.3), in which the different crossbeams (3) are blocked in place.

In order to easily manipulate the blocking element (5), the blocking element (5) preferably comprises two recesses (7) located opposite one another which are dimensioned in such a way that they are suitable to serve as a grip during the movement of the blocking element (5) between the first and second position.

The fence (1) according to this invention may be used as a barrier installation to protect persons, machinery, tools, goods and buildings where lift trucks or other traffic is present. The fence can also be used as a physical screen along a pit or on a gantry in order to thereby prevent persons from falling into the pit or from the gantry. The described fence furthermore requires a minimum of maintenance, has a long service life, can be simply installed, moved and dismantled, and is impact-resistant.

The invention is not limited to the particular embodiments illustrated in the drawings and described above in detail. Those skilled in the art will recognize that other arrangements could be devised. The invention encompasses every possible combination of the various features of each embodiment disclosed. One or more of the elements described herein with respect to various embodiments can be implemented in a more separated or integrated manner than explicitly described, or even removed or rendered as inoperable in certain cases, as is useful in accordance with a particular application.

The invention claimed is:

1. A fence, comprising:

at least two hollow fence posts, between which at least two crossbeams extend;

wherein each crossbeam fits into an opening provided in one of the fence posts;

a plate-shaped blocking element extending into a cavity of one of the fence posts which is provided to block the crossbeams against displacement;

wherein the crossbeams are provided in their external circumference with at least one recess which lies within the hollow inner area of the fence post;

wherein the plate-shaped blocking element is movable between a first position in which the crossbeams are movable into and out of the fence posts and a second position in which the crossbeams are blocked in place;

wherein the aforementioned blocking element comprises at least two openings positioned at a distance from one another, which are each provided to block a crossbeam against displacement;

wherein the aforementioned blocking element is provided between the aforementioned blocking element openings with one or more break lines, along which the blocking element is breakable into different separate blocking elements.

2. Fence according to claim 1, characterized in that the crossbeam comprises two recesses located opposite one another, which extend across the longitudinal direction of the crossbeam.

3. Fence according to claim 1, characterized in that the fence posts are made from tubular plastic material, extending essentially vertically in the assembled condition of the fence, and that the crossbeams are made from tubular plastic material, extending essentially horizontally in the assembled condition of the fence.

4. Fence according to claim 1, characterized in that the openings provided in the blocking element, on one side, have a width which is greater than the width of the crossbeam to be blocked, and, on an opposite side, have a width which is smaller than the width of the crossbeam to be blocked.

5. Fence according to claim 1, characterized in that the blocking element is provided with a first, second and third opening, which are provided to block a first, second and third crossbeam respectively, wherein one or more break lines are provided between the first and second opening, and between the second and third opening.

6. Fence according to claim 1, characterized in that the blocking element comprises, in its outer circumference, at least one recess which is dimensioned in such a way that it is suitable to serve as a grip during the movement of the blocking element between the first and second position.

7. Fence according to claim 1, characterized in that the blocking element is made from plastic.

8. Fence according to claim 1, characterized in that each fence post comprises at least one essentially flat rear side and front side and at least two essentially flat side surfaces, and that, following attachment of the crossbeam to the fence posts, the blocking element lies against one of the flat side surfaces.

9. Fence according to claim 1, characterized in that each fence post has a round cross-section and, following attachment of the crossbeam to the fence posts, the blocking element lies against a curved side wall.

10. Fence according to claim 1, characterized in that each fence post comprises a base plate to attach it to the underlying structure.

* * * * *